US010589546B2

(12) United States Patent
Van Bekkem et al.

(10) Patent No.: US 10,589,546 B2
(45) Date of Patent: Mar. 17, 2020

(54) METHOD FOR PROCESSING A WEB IN AN APPARATUS

(71) Applicant: Océ Holding B.V., Venlo (NL)

(72) Inventors: Johannes M. Van Bekkem, Venlo (NL); Maurice J. C. Lemmens, Venlo (NL); Leonardus R. A. Willems, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 225 days.

(21) Appl. No.: 15/715,734

(22) Filed: Sep. 26, 2017

(65) Prior Publication Data

US 2018/0093497 A1 Apr. 5, 2018

(30) Foreign Application Priority Data

Oct. 4, 2016 (EP) ..... 16192128

(51) Int. Cl.
*B41J 11/00* (2006.01)
*B41J 15/04* (2006.01)
(Continued)

(52) U.S. Cl.
CPC ..... *B41J 11/003* (2013.01); *B41J 11/005* (2013.01); *B41J 11/007* (2013.01);
(Continued)

(58) Field of Classification Search
CPC ..... B41J 11/003; B41J 11/0045; B41J 11/005; B41J 11/0055; B41J 11/007; B41J 11/04; B41J 15/04; B41J 25/308; B65H 2404/72
See application file for complete search history.

(56) References Cited

U.S. PATENT DOCUMENTS 5,513,920 A * 5/1996 Whritenor ..... B41J 17/16 242/607
5,761,070 A * 6/1998 Conners ..... B07C 5/3422 345/426

(Continued)

FOREIGN PATENT DOCUMENTS

EP 2774767 A1 9/2014
JP 2004-230839 A 8/2004

(Continued)

OTHER PUBLICATIONS

Machine Translation of JP 2012-024959 (Obtained Jun. 18, 2019) (Year: 2012).*

(Continued)

*Primary Examiner* — David H Banh
(74) *Attorney, Agent, or Firm* — Birch, Stewart, Kolasch & Birch, LLP

(57) ABSTRACT

A web printing apparatus comprising a support platen facing the processing station for supporting the web, when being processed by the processing station and a first guard for guarding a side edge of a web, the first guard being connectable to the support platen for guiding the web along a transport path, when the web is processed by the processing station. A detector is provided for detecting the first guard when connected to the support platen as well as a control unit configured for controlling the processing station to process the web, wherein the control unit is configured to identify the guard based on a detection signal provided by the detector to the control unit. Thereby, the first guard is identified by the control unit which may then control the movement of the print carriage to avoid the first guard, preventing collisions.

14 Claims, 4 Drawing Sheets

(51) Int. Cl.
*B41J 11/04* (2006.01)
*B41J 25/308* (2006.01)

(52) U.S. Cl.
CPC ..... *B41J 11/0045* (2013.01); *B41J 11/0055* (2013.01); *B41J 11/04* (2013.01); *B41J 15/04* (2013.01); *B41J 25/308* (2013.01); *B65H 2404/72* (2013.01)

(56) References Cited

U.S. PATENT DOCUMENTS 6,226,094 B1* 5/2001 Watanabe ..... G06F 17/214 358/1.11
6,250,624 B1* 6/2001 Kiyohara ..... B41J 11/005 226/196.1
7,037,011 B1* 5/2006 Forest ..... B41J 32/00 101/93.04
2003/0077101 A1 4/2003 Feiner
2005/0271449 A1* 12/2005 Hirte ..... B41J 3/4075 400/642
2006/0133879 A1* 6/2006 Mindler ..... B41J 17/32 400/242
2006/0269346 A1* 11/2006 Takayama ..... B26D 1/305 400/613
2010/0247212 A1* 9/2010 Yamaguchi ..... B41J 3/4075 400/229
2011/0025746 A1* 2/2011 Doo ..... B41J 11/002 347/16
2011/0050826 A1 3/2011 Katagami et al.
2013/0076821 A1* 3/2013 Yamauchi ..... B41J 19/202 347/14
2013/0136521 A1 5/2013 Garcia et al.
2014/0152753 A1* 6/2014 Moriyama ..... B41J 11/009 347/110
2016/0089905 A1 3/2016 Wakabayashi et al.

FOREIGN PATENT DOCUMENTS

JP 2010-264596 A 11/2010
JP 2012-24959 A 2/2012
JP 2 614 963 A1 7/2013
WO WO 2015/113605 A1 8/2015

OTHER PUBLICATIONS

European Search Report, dated Jan. 29, 2018, for European Application No. 17192344.
European Search Report, issued in Application No. 16 19 2128, dated Mar. 24, 2017.

* cited by examiner

Fig. 1A
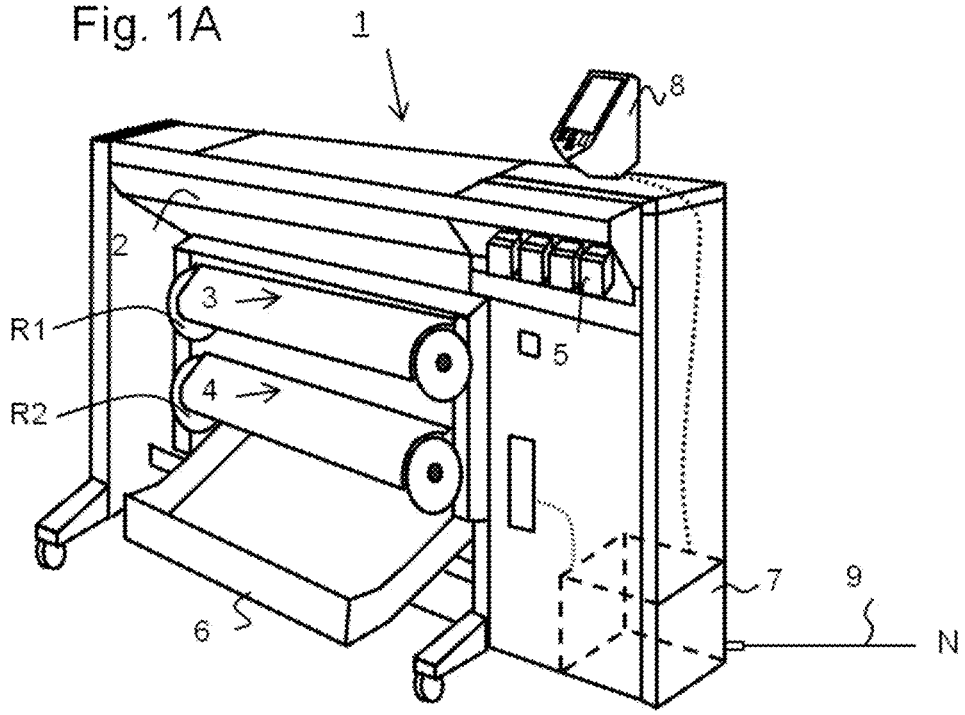
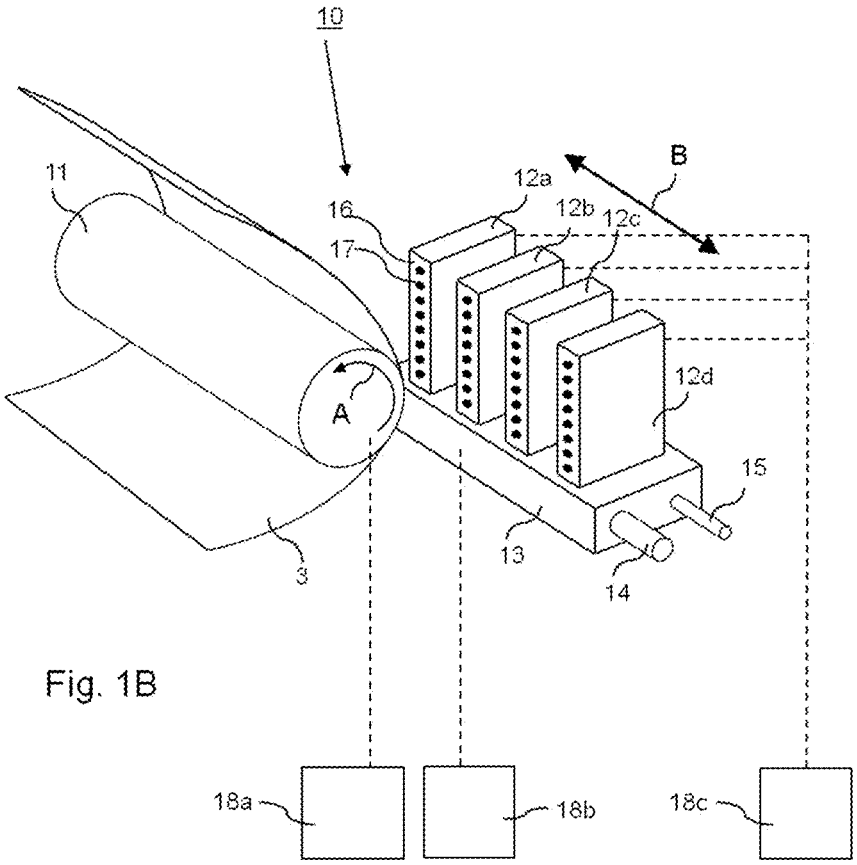
Fig. 1B

METHOD FOR PROCESSING A WEB IN AN APPARATUS

FIELD OF THE INVENTION

The present invention relates to a method for processing a web in an apparatus. The present invention further relates to a kit comprising a first guard for guarding a side edge of a web and a second guard for guarding a side edge of a web and an apparatus.

The present invention further relates to an apparatus comprising a processing station for processing a web. The present invention further relates to a kit comprising a first guard for guarding a side edge of a web and a second guard for guarding a side edge of a web.

BACKGROUND ART

A known printing apparatus comprises a print station for processing a web by printing an image on the web, a transport device, such as a transport nip, for transporting the web through a transport path along the print station and a support platen facing the print station for supporting the web, when the web is processed by the print station. A pair of side guards is connected to the support platen for guiding the web along the transport path while guarding a respective side edge of the web, i.e. limiting a deformation or protrusion of the side edge of the web away from the support platen. The print station comprises a print assembly movably arranged with the support platen in a direction across the transport path to process the web. The pair of side guards is positioned on the support platen to prevent each side edge of the web from touching the print station, when the web is transported along the print station, as this can damage or pollute the web or the print station.

Each side guard has a fixed shape and is connected to the support platen to fence and accommodate the side edge of the web between a guard portion of the side guard and the support platen, when guiding the web through the transport path. When the side guards are connected to the support platen, the print station, including the print assembly, is arranged at a predetermined gap from the support plate for avoiding that the print station touches the guard portion of the side guards, when the print station is moved across the transport path.

A web to be processed in the printing apparatus may have a varying property, such as varying thicknesses, depending on the web selected. However, the side guards limit a thickness of the web to be processed. Even more, when using a web having a relatively low thickness, a distance between a process surface of the web, which faces the print station, and the print assembly increases as the print station still has to be arranged at the predetermined gap from the support plate for avoiding that the print station collides with the side guards, when the print station is moved across the transport path. As a result, a print quality of the image printed on the relatively thin web may be less than when arranging the print station at a desired distance from the web.

Moreover, a web to be processed may have other varying properties, such as a differing flatness of the web, such as a wavy structure compared to a substantial planar structure of the web.

SUMMARY OF THE INVENTION

It is accordingly an object of the present invention to provide a method for processing a web in an apparatus, wherein the web is guided by a guard for guiding a side edge of the web along the processing station of the apparatus and wherein the processing of the web is improved.

This object is attained by an apparatus comprising

- a processing station for processing a web;
- a transport device for transporting the web through a transport path along the processing station;
- a support platen facing the processing station for supporting the web, when being processed by the processing station;

a first guard for guarding a side edge of a web, the first guard being connectable to the support platen for guiding the web along the transport path, when the web is processed by the processing station;

a detector for detecting the first guard when connected to the support platen;

and a control unit configured for controlling the processing station to process the web, wherein the control unit is configured to identify the guard based on a detection signal provided by the detector to the control unit.

When connected to the support platen, the first guard extends over a lateral side of the web. The first guard with the support platen forms a passage wherein the movement of the web's edge is restricted, specifically in a direction perpendicular to the support platen. The passage has a predefined gap spacing defined by first guard. Dependent on the properties (e.g. thickness and/or flexibility) of the web material being used in a print job, a specific gap or spacing of the first guard is required. As the first guard extends partially over the web medium, there is the risk of the print heads of the print station colliding with the guard. This is prevented by the detector detecting the first guard and identifying the first guard. Identification of the first guard allows the control unit to incorporate shape, size, specifically height, and/or position information. The movement of the print station is then controlled based on this information, such that the print station avoids the first guard. This may for example be done by adjusting a height spacing of the print station with respect to the support platen or by restricting the lateral movement of the print station. Thereby, collision between the print station and the first guard is avoided without operator interference. The object of the present invention has been achieved.

More specific optional features of the invention are indicated in the dependent claims.

In an embodiment, the apparatus according to the present invention further comprises a moveable carriage for moving the processing station with respect to the support platen, wherein the detector and the processing station are mounted on the carriage. The processing or print station preferably is provided on the carriage configured to translate along a beam extending over the width of the support platen. The detector is preferably an optical detector, such as a camera, which may be used for other purposes such as determining the print quality or a measure for the web transportation. By providing the detector on the carriage, collisions with guard are effectively prevented as the detector and print station move in unison. No input by an operator is required when the first guard is adjusted during a print job, as the detector will identify the adjusted first guard when the carriage approaches the adjusted first guard.

In another embodiment, the first guard further comprises

- a connection base or contact portion connectable to the support platen
- a restrictor plate or guard portion for restricting deformation of the web in a direction away from the support platen; and a spacer or bridging portion connecting the connection base to the restrictor plate, the spacer being configured for positioning the restrictor plate at a predefined distance from the support platen when the connection base is connected to the support platen. The connection base may be connected to the support platen by taping, gluing, magnetism, suction, etc. The connection base preferably comprises a flat base support surface corresponding to the support platen. The connection base is connected to an end of the spacer, which in use extends away from the plane of the support platen. Away from the support platen, the spacer is connected to the restrictor plate, which restrictor plate during use preferably extends substantially parallel to the support platen. The spacer determines the distance or gap between the support platen and the restrictor plate or guard portion.

In a further embodiment, the control unit is configured for determining the position of the connected guard with respect to the support platen. The position information is then transmitted to the control unit, which may then control the print station to avoid the determined position of the first guard. Preferably, the lateral motion of the print station is restricted, such that movement of the print station is reversed before reaching the position of the first guard.

In an embodiment, the control unit is configured to control movement of the processing station to prevent contact between the processing station and the first guard connected to the support platen. In another embodiment, the processing station is arranged having a gap with respect to the support platen during processing of the web and wherein control unit is configured for adjusting a gap based on an identity of the identified guard. The control unit may for example raise the print station, i.e. increase the distance between the print station and the support platen, such that the print station is able to pass over the first guard. Preferably, the lateral motion of the print station is restricted, such that movement of the print station is reversed before reaching the position of the first guard.

In a further embodiment, the control unit comprises a memory storing an identity table, wherein the control unit is arranged for selecting a guard from the identity table based on the detection signal. The operator may apply a plurality of guards, each having different dimensions. One or more of said dimensions are stored in the identity table, for example the guard height or gap spacing. By identifying the first guard, the control unit is able to retrieve one or more properties or dimensions of the first guard from the memory. Thus, the controller identifies the first guard based on one or more characteristics provided by the detection signal from the detector. Based on said characteristics, the controller is able to identify the first guard by selecting one of a plurality of guard profiles stored on the memory. The guard profiles are preferably distinguishable from one another by the one or more determined characteristics.

In an embodiment, the first guard comprises an identifier attribute for identifying the guard. The identifier attribute provides a unique distinction based on which the detector is able to identify the first guard from a plurality of guards. Preferably, the identifier attribute comprises a marker on the first guard. The marker comprises for example identity or height information readable by the detector. The information may be in the form of a code or coding provided on the guard, specifically on the upper surface of the guard portion. The coding is readable by the detector, for example as a bar or QR code. In another example, the identifier attribute comprises a color or shape of the first guard.

In a preferred embodiment, the apparatus according to the present invention comprises a user interface. The control unit is configured to select a first guard profile from a plurality of first guard profiles stored on the memory of the control unit based on print job information. The print job information preferably comprises media type information, such as material type and/or width. The control unit then controls the user interface to transmit, specifically to display, the selected first guard profile to the operator. The operator then may apply the first guard corresponding to the first guard profile to the support platen. Any errors by the operator in selecting the first guard are then eliminated.

In another aspect, the present invention provides a first guard for use in the apparatus according to the present invention. The guard preferably comprises the identifier attribute or marker as discussed above.

In a further aspect, the present invention provides a method of controlling a processing station in a web printing apparatus preferably according to the present invention, the method comprising the steps of:

a detector sensing a first guard for guarding a side edge of a web when connected to a support platen of the printing apparatus;

identifying the first guard from data generated by the detector;

controlling the movement of the processing station to avoid contact with the identified first guard.

The present invention eases the starting of a new print job or media loading by automatically identifying the first guard and adjusting the movement of the print station to avoid this first guard. Thereby, the operator time during startup is reduced.

In an embodiment, the method according to the present invention further comprises:

determining a height parameter of the identified first guard; and adjusting a gap between the processing station and the support platen based on the height parameter.

In a further embodiment, the method according to the present invention further comprises:

determining a position of the identified first guard; and controlling a translational movement of the processing station over the support platen, such that the processing stations avoids the determined position.

In another aspect, the present invention provides a method for processing a web in an apparatus, the apparatus comprising a processing station for processing the web, a transport device for transporting the web through a transport path along the processing station, and a support platen facing the processing station for supporting the web, when being processed by the processing station, wherein the method comprises the steps of: a) selecting a guard for guarding a side edge of the web from one of a first guard and a second guard based on the web to be processed, each guard comprising a guard portion for fencing the transport path of a side edge of the web, and wherein each guard is connectable to the support platen for guiding the web along the transport path, and wherein the first guard and the second guard have differing shapes with respect to one another to guide webs of differing property, respectively, when being connected to the support platen; b) connecting the selected guard to the support platen at a desired position to accommodate a side edge of the web, when transporting the web over the support platen; and c) processing the web by the processing station while a side edge of the web is guided by the selected guard along the transport path.

According to the method a guard is selected based on the web to be processed from a first guard and a second guard, wherein the first guard and the second guard have differing shapes with respect to one another to guide webs of differing property, respectively, when being connected to the support platen. In this way, the guard is used for guiding the web, which guide may accommodate the specific property of the web while optimizing the processing of the web by the processing station. In an embodiment, the first guard and the second guard have differing shapes with respect to one another to accommodate webs of differing thicknesses, respectively, when being connected to the support platen. In this way, the guard is used for guiding the web, which guide may accommodate the thickness of the web while optimizing the processing of the web by the processing station. In an example of the embodiment, when a relatively thin web is processed, a first guard is selected, which provides a relatively small gap between its guard portion and the support platen, when being connected to the support platen. In this way, the processing station can be arranged at a relatively small gap with respect to the support platen to process the web at a relatively small distance, while avoiding that the processing station touches the guard. In an alternative example, when a relatively thick web is processed, a second guard is selected, which provides a relatively large gap between its guard portion and the support platen, when being connected to the support platen. In this way, the side edge of the web of the thicker web can be accommodated between a guard portion of the side guard and the support platen, such that the side edge of the web is guided by the second guard through the transport path along the processing station. At the same time, the processing station can be arranged at a relatively large gap with respect to the support platen, while maintaining a relatively small distance to the process surface of the, thicker, web to optimize the processing of the web and, at the same time, avoid that the processing station touches the guard. In alternative embodiments, the differing property of the web may be a differing surface property of the web, such as roughness or stickiness of the surface of the web, may be a differing flatness of the web, such as a wavy structure compared to a substantial planar structure of the web, may be a differing dimensional stability of the web, such as a heat sensitive web having a considerable heat expansion behavior compared to a heat stable web having substantially no heat expansion, and may be any other suitable property of the web.

In examples, the differing shapes of the first guard and the second guard with respect to one another may be a differing predetermined gap for accommodating a thickness of the web in an assembled state of the guard and the support platen and may be a differing size of the guard portion of the first guard and the second guard, respectively, for guarding the web, such as a differing width of the guard portion in a transverse direction across to the transport path and a differing length of the guard portion in a transport direction along to the transport path.

Furthermore, a selection of the guard from the first guard and the second guard provides a reliable guiding of the web and processing of the web by the processing station as the shape of the respective guards provides a predetermined position of the guard portion relative to the support platen, when the guard is connected to the support platen.

In a particular example, a pair of guards is selected for guarding both side edges of the web, wherein the guards of the pair of guards are both selected from one of a first guard and a second guard based on the web to be processed, and wherein both selected guards are the same selection. As both side edges of a web commonly have the same property, such as thickness, the selection of a guard for a pair of guards for guiding a web is regularly the same for both sides of the web.

In examples of the processing step c), the step may comprise the step of heat treating the web, may comprise the step of printing an image onto the web, may comprise the step of curing an image on the web, such as providing a radiation onto the web for curing the image, may comprise the step of drying the image on the web and may comprise any combination of the steps mentioned.

In an embodiment, the method further comprises the step of d) determining the presence of the connected guard at the support platen. In this way, the apparatus may adjust the processing of the web based on the presence of the connected guard at the support platen. The determining step may be carried out by the apparatus, such as by detecting the presence of the connected guard at the support platen by a detector of the apparatus. In another example, the apparatus may be configured to determine a presence of the connected guard at the support platen in response to an opening state of a cover or door of the apparatus, which provides an entry to the support platen. An opening state of the cover may be detected by a control unit of the apparatus. In even another example, a control unit of the apparatus may be configured to assume, that a selected guard is connected by an operator to the support platen during an opening state of the cover for accessing the support platen.

Alternatively, the determining step may be carried out by an operator, which detects the presence of the connected guard at the support platen. The operator may provide an operator input to the apparatus to communicate the presence of the connected guard at the support platen.

In an example, the apparatus may raise the processing station to a predetermined safe distance from the support platen based on the presence of the connected guard at the support platen to avoid any damage occurring to the web and/or the processing station. In another example, the apparatus may adjust the processing area relative to the support platen to avoid that the connected guard and/or the support platen is processed by the processing unit, such as avoiding that an image is printed by a print station.

In any way, the apparatus may adjust the processing of the web based on the determination, that the connected guard is present at the support platen.

In an embodiment, step d) comprises identifying the connected guard, which is selected in step a). In this way, the apparatus is provided information on the shape of the connected guard based on the identity of the connected guard and is able to optimize the processing of the web based on the identified guard, which is connected to the support platen for guiding the web.

The identifying step may be carried out by detecting an identifier attribute of the connected guard, when connected at the support platen. Such an identifier attribute may comprise one of a color of the guard, a dimension of the guard and a marker of the guard. Such marker may comprise a code, such as a binary code, which is detectable by a detector of the apparatus. In any way, the apparatus may comprise a detector arranged for detecting the identifier attribute of the guard to identify the connected guard, which is connected to the support platen. The detector may be connected to the processing station, such as mounted on a carriage of a moveable print station, which carriage is moveably arranged relative to the support platen. The processing station may be arranged at a predetermined safe distance from the support platen during the detecting step carried out by the detector. In this way, any damage occurring to the web, the detector and/or the processing station is avoided.

Alternatively, the identifying step may be carried out by an operator, which identifies the connected guard, such as based on an identifier attribute of the guard. The operator may provide an operator input to the apparatus to communicate the identity of the connected guard, which guard is selected before connecting it to the support platen.

In an embodiment, step d) comprises determining the position of the connected guard with respect to the support platen. In this way, information is provided on the position of the guard, after being connected to the support platen. The position determining step may be carried out by a detector of the apparatus. The detector may be connected to the processing station, such as mounted on a carriage of a moveable print station, which carriage is moveably arranged relative to the support platen. The processing station may be arranged at a predetermined safe distance from the support platen during the detecting step carried out by the detector. In this way, any damage occurring to the web, the detector and/or the processing station is avoided.

Alternatively, the position determining step may be carried out by an operator. The operator may provide an operator input to the apparatus to communicate the position of the connected guard on the support platen.

The apparatus may adjust the processing area relative to the support platen based on the position of the connected guard to avoid that the connected guard and/or the support platen is processed by the processing unit, such as avoiding that an image is printed by a print station. In any way, the processing area may be adjusted to process the web only.

Additionally, the information of the identity of the connected guard may be combined with the information of the position of the connected guard to adjust the processing area relative to the support platen. In an example, the first guard may have a guard portion having a size providing a guarding area, which covers the side edge of the web, i.e. in a plane of the web, which guarding area is different from a respective guarding area of a guard portion of the second guard. As such, the processing area of step c) may be optimized based on the knowledge of the position and size of the guard portion of the selected guard.

In an embodiment, the processing step c) comprises adjusting a processing parameter for processing of the web in response to step d). In this way, the processing of the web may be optimized based on the knowledge of the presence of the connected guard, such as based on a position of the connected guard and identity of the connected guard, which is selected in step a).

In an embodiment, the processing station is arranged having a gap with respect to the support platen during processing of the web and the adjusting step of step c) comprises adjusting the gap between the processing station and the support platen based on the selected guard. In this way, based on the knowledge of the shape of the selected guard, a collision of the processing station, such as a moveable print station, to the connected guard is avoided while optimizing a processing distance between the processing station and the web.

In an embodiment, the adjusting step of step c) comprises adjusting the area relative to the support platen to be processed by the processing station based on the determined presence of the connected guard. In this way, it may be avoided that the connected guard and/or the support platen is processed by the processing unit, such as avoiding that the guard is polluted by an ink to form an image, which ink is printed by a print station onto the web in a print area. In case the ink is a radiation curable ink, such ink may provide a safety risk, when the ink pollutes the connected guard and is not cured by a radiation source, which is arranged away from the support platen, such as downstream from the print station in a transport direction of the web.

In another aspect of the invention a kit is provided comprising a first guard for guarding a side edge of a web and a second guard for guarding a side edge of a web and an apparatus comprising a processing station for processing the web and a support platen facing the processing station for supporting the web along a transport path, wherein each guard comprises a guard portion for fencing a transport path of a side edge of a web, and wherein each guard is connectable to the support platen for guiding the web along the transport path, when the web is processed by the processing station, and wherein the first guard and the second guard have differing shapes with respect to one another to guide webs of differing property, respectively, when being connected to the support platen.

A guard may be selected from the first guard and the second guard of the kit and connected to the support platen of the apparatus for guiding a side edge of the web. The guard may be selected based on a property of the web, such as thickness of the web, to be processed by the processing station of the apparatus. In this way, a processing of the web by the apparatus may be improved.

In particular, the kit may be used in the method according to the present invention for processing a web in an apparatus.

In an embodiment, each of the first guard and second guard comprises an identifier attribute for identifying the guard. The identifier attribute provides a reliable and simple way of identifying the guard, when it is connected to the support platen.

In an embodiment, the identifier attribute comprises a marker of the first guard and second guard, respectively. In this way, the identity of the respective guard can be reliably determined based on the marker, such as by detecting the marker of a connected guard using a detector of the apparatus.

In an embodiment, the identifier attribute comprises a color of the first guard and second guard, respectively. In this way, the identity of the guard is easily detectable by a detector and/or by an operator. The operator may easily select the desired guard based on the color, i.e. even if the difference in shape of the guard is not easy to determine by an operator.

In an embodiment, identifier attribute representing said shape of the first guard and second guard, respectively. In this way, by detecting the identifier attribute, said shape of the first guard and second guard may be determined. An apparatus may comprise a database of identifier attributes, which are related to the shape of the respected guard. As such, a control unit of the apparatus, which is connected to the database, is able to determine the shape of the respected guard based on the identifier attribute of the respective guard. Alternatively, the database may be electronically available outside the apparatus, such as on a server, and the control unit of the apparatus may be operatively connected to the database, such as by an internet connection to the server, to determine the shape of the respected guard.

In another aspect an apparatus is provided comprising a processing station for processing a web, a transport device for transporting the web through a transport path along the processing station, a support platen facing the processing station for supporting the web, when being processed by the processing station, and a control unit configured for controlling the processing station to process the web based on a selected guard arranged for guarding a side edge of the web, when the guard is connected to the support platen to guide the web through the transport path along the processing station, wherein the guard is selected from one of a first guard and a second guard of the kit according to the present invention. In this way, the control unit of the apparatus may optimize the processing of the web based on the selected guard, which is connected to the support platen.

In an embodiment, the apparatus further comprises a detector for detecting the guard connected to the support platen, and wherein the control unit is configured to identify the guard based on a detection signal provided by the detector to the control unit. In this way, the apparatus may identify the guard, which is connected to the support platen. Furthermore, the control unit of the apparatus may optimize the processing of the web based on the identity of the detected guard.

The control unit may be configured to arrange the processing station including the detector, which is mounted on the processing station, at a predetermined safe distance from the support platen during a detecting step carried out by the detector. In this way, any damage occurring to the web, the detector and/or the processing station is avoided.

In another aspect a kit is provided comprising a first guard for guarding a side edge of a web and a second guard for guarding a side edge of a web, wherein each guard comprises a guard portion for fencing a transport path of a side edge of a web, and wherein each guard is connectable to a support platen of an apparatus according to the present invention for guiding the web through a transport path along a processing station of said apparatus, said support platen facing the processing station, and wherein the first guard and the second guard have differing shapes with respect to one another to guide webs of differing property, respectively, when being connected to the support platen.

In an embodiment, the first guard and the second guard of the kit have differing shapes with respect to one another to accommodate webs of differing thicknesses, respectively, when being connected to the support platen. In this way, the guard is used for guiding the web, which may accommodate the thickness of the web while optimizing the processing of the web by the processing station.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein:

FIG. 1A shows an image forming apparatus, wherein printing is achieved using a wide format inkjet printer.

FIG. 1B shows an ink jet printing assembly.

DETAILED DESCRIPTION OF THE DRAWINGS

Figure 2A:
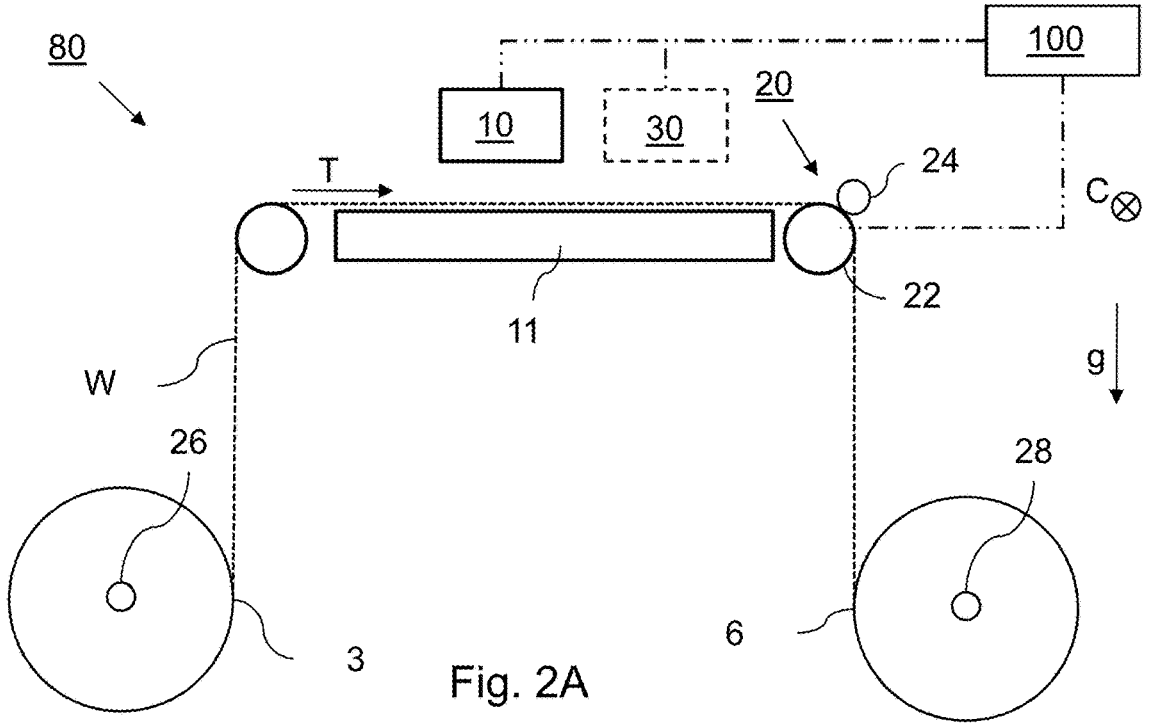
FIGS. 2A-2B show schematically an embodiment of an apparatus for processing a web by a processing unit according to the present invention.

The present invention will now be described with reference to the accompanying drawings, wherein the same reference numerals have been used to identify the same or similar elements throughout the several views.

FIG. 1A shows an image forming apparatus 1, wherein printing is achieved using a wide format inkjet printer. The wide-format image forming apparatus 1 comprises a housing 2, wherein the printing assembly, for example the ink jet printing assembly shown in FIG. 1B is placed. The image forming apparatus 1 also comprises a storage means for storing image receiving member 3, 4, a delivery station to collect the image receiving member 3, 4 after printing and storage means 5 for marking material. In FIG. 1A, the delivery station is embodied as a delivery tray 6. Optionally, the delivery station may comprise processing means for processing the image receiving member 3, 4 after printing, e.g. a folder or a puncher. The wide-format image forming apparatus 1 furthermore comprises means for receiving print jobs and optionally means for manipulating print jobs. These means may include a user interface unit 8 and/or a control unit 7, for example a computer.

Images are printed on an image receiving member, for example paper, supplied by a roll 3, 4. The roll 3 is supported on the roll support R1, while the roll 4 is supported on the roll support R2. Alternatively, cut sheet image receiving members may be used instead of rolls 3, 4 of image receiving member. Printed sheets of the image receiving member, cut off from the roll 3, 4, are deposited in the delivery tray 6.

Each one of the marking materials for use in the printing assembly are stored in four containers 5 arranged in fluid connection with the respective print heads for supplying marking material to said print heads.

The local user interface unit 8 is integrated to the print engine and may comprise a display unit and a control panel. Alternatively, the control panel may be integrated in the display unit, for example in the form of a touch-screen control panel. The local user interface unit 8 is connected to a control unit 7 placed inside the printing apparatus 1. The control unit 7, for example a computer, comprises a processor adapted to issue commands to the print engine, for example for controlling the print process. The image forming apparatus 1 may optionally be connected to a network N. The connection to the network N is diagrammatically shown in the form of a cable 9, but nevertheless, the connection could be wireless. The image forming apparatus 1 may receive printing jobs via the network. Further, optionally, the controller of the printer may be provided with a USB port, so printing jobs may be sent to the printer via this USB port.

FIG. 1B shows an ink jet printing assembly 10. The ink jet printing assembly 10 comprises supporting means for supporting an image receiving member 3. The supporting means 11 are shown in FIG. 1B as a platen 11, but alternatively, the supporting means 11 may be a flat surface. The platen 11, as depicted in FIG. 1B, is a rotatable drum 11, which is rotatable about its axis as indicated by arrow A. The supporting means 11 may be optionally provided with suction holes for holding the image receiving member 3 in a fixed position with respect to the supporting means 11. The inkjet printing assembly 10 comprises print heads 12*a*-12*d*, mounted on a scanning print carriage 13. The scanning print carriage 13 is guided by suitable guiding means 14, 15 to move in reciprocation in the main scanning direction B. Each print head 12*a*-12*d* comprises an orifice surface 16, which orifice surface 16 is provided with at least one orifice 17. The print heads 12*a*-12*d* are configured to eject droplets of marking material onto the image receiving member 3. The platen 11, the carriage 13 and the print heads 12*a*-12*d* are controlled by suitable controlling means 18*a*, 18*b* and 18*c*, respectively.

The image receiving member 3 may be a medium in web or in sheet form and may be composed of e.g. paper, cardboard, label stock, coated paper, plastic, canvas, film or textile. Alternatively, the image receiving member 3 may also be an intermediate member, endless or not. Examples of endless members, which may be moved cyclically, are a belt or a drum. The image receiving member 3 is moved in the sub-scanning direction A by the platen 11 along four print heads 12*a*-12*d* provided with a fluid marking material. A scanning print carriage 13 carries the four print heads 12*a*-12*d* and may be moved in reciprocation in the main scanning direction B parallel to the platen 11, such as to enable scanning of the image receiving member 3 in the main scanning direction B. Only four print heads 12*a*-12*d* are depicted for demonstrating the invention. In practice an arbitrary number of print heads may be employed. In any case, at least one print head 12*a*-12*d* per color of marking material is placed on the scanning print carriage 13. For example, for a black-and-white printer, at least one print head 12*a*-12*d*, usually containing black marking material is present. Alternatively, a black-and-white printer may comprise a white marking material, which is to be applied on a black image-receiving member 3. For a full-color printer, containing multiple colors, at least one print head 12*a*-12*d* for each of the colors, usually black, cyan, magenta and yellow is present. Often, in a full-color printer, black marking material is used more frequently in comparison to differently colored marking material. Therefore, more print heads 12*a*-12*d* containing black marking material may be provided on the scanning print carriage 13 compared to print heads 12*a*-12*d* containing marking material in any of the other colors. Alternatively, the print head 12*a*-12*d* containing black marking material may be larger than any of the print heads 12*a*-12*d*, containing a differently colored marking material.

The carriage 13 is guided by guiding means 14, 15. These guiding means 14, 15 may be rods as depicted in FIG. 1B. The rods may be driven by suitable driving means (not shown). Alternatively, the carriage 13 may be guided by other guiding means, such as an arm being able to move the carriage 13. Another alternative is to move the image receiving material 3 in the main scanning direction B.

Each print head 12*a*-12*d* comprises an orifice surface 16 having at least one orifice 17, in fluid communication with a pressure chamber containing fluid marking material provided in the print head 12*a*-12*d*. On the orifice surface 16, a number of orifices 17 is arranged in a single linear array parallel to the sub-scanning direction A. Eight orifices 17 per print head 12*a*-12*d* are depicted in FIG. 1B, however obviously in a practical embodiment several hundreds of orifices 17 may be provided per print head 12*a*-12*d*, optionally arranged in multiple arrays. As depicted in FIG. 1B, the respective print heads 12*a*-12*d* are placed parallel to each other such that corresponding orifices 17 of the respective print heads 12*a*-12*d* are positioned in-line in the main scanning direction B. This means that a line of image dots in the main scanning direction B may be formed by selectively activating up to four orifices 17, each of them being part of a different print head 12*a*-12*d*. This parallel positioning of the print heads 12*a*-12*d* with corresponding in-line placement of the orifices 17 is advantageous to increase productivity and/or improve print quality. Alternatively multiple print heads 12*a*-12*d* may be placed on the print carriage adjacent to each other such that the orifices 17 of the respective print heads 12*a*-12*d* are positioned in a staggered configuration instead of in-line. For instance, this may be done to increase the print resolution or to enlarge the effective print zone, which may be addressed in a single scan in the main scanning direction. The image dots are formed by ejecting droplets of marking material from the orifices 17.

Upon ejection of the marking material, some marking material may be spilled and stay on the orifice surface 16 of the print head 12*a*-12*d*. The ink present on the orifice surface 16, may negatively influence the ejection of droplets and the placement of these droplets on the image receiving member 3. Therefore, it may be advantageous to remove excess of ink from the orifice surface 16. The excess of ink may be removed for example by wiping with a wiper and/or by application of a suitable anti-wetting property of the surface, e.g. provided by a coating.

Figure 2B:
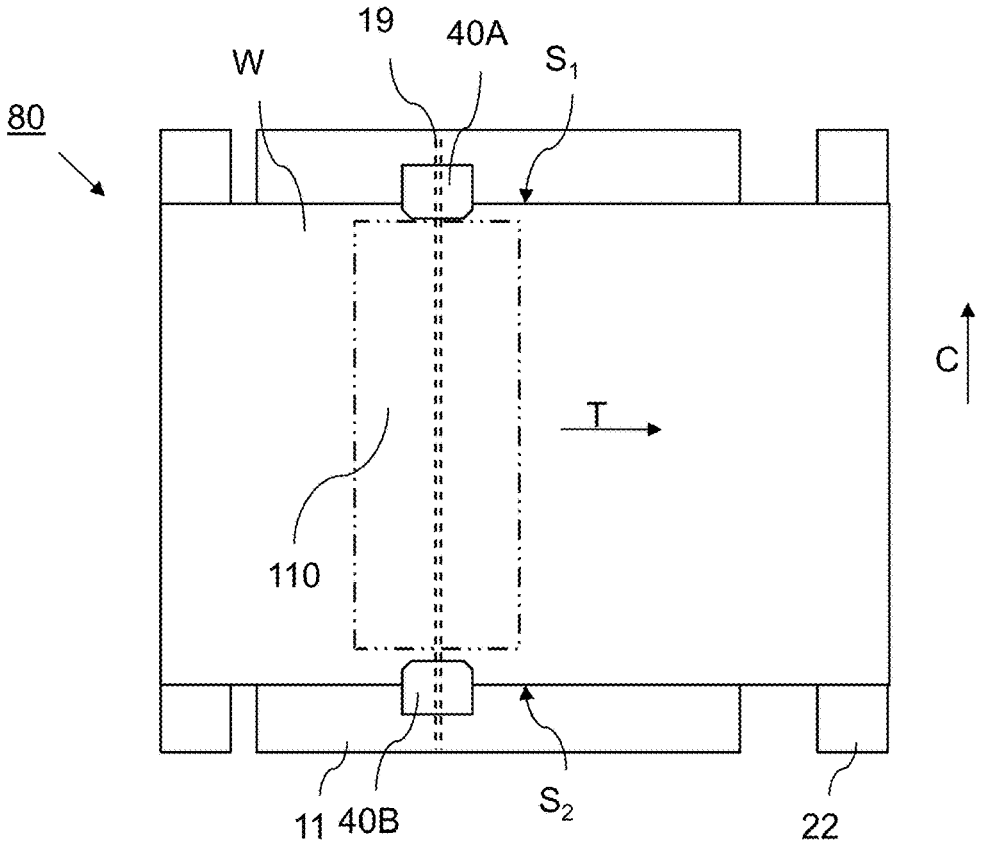

FIG. 2A shows schematically an embodiment of an apparatus for processing a web according to the present invention. FIG. 2A shows a side view of the apparatus 80. FIG. 2B shows a plane view on the support platen of the apparatus 80. The apparatus 80 comprises a processing station 10, such as a print station comprising a carriage and a print head assembly as shown in FIG. 1B, a support platen 11 facing the processing station, a transport device 20, which is a nip comprising a driven roller 22 and a pressure roller 24, and a control unit 100. Optionally, the apparatus 80 may further comprise a radiation curing station 30 for emitting a radiation onto the web W for curing an ink applied on a process surface of the web W downstream of the processing station 10. The transport device 20 is arranged downstream of a processing unit 10, such as a print head assembly, and transports a web W along a transport path in a transport direction T along the processing unit 10, optionally including transporting the web W along the radiation curing station 30. The web is supplied from a roll 3, which is supported by a spindle 26. The web is moved by the transport nip 20 along the transport path from the supply roll 3 along the processing unit 10 towards a receiving roll 6. The receiving roll 6 is supported on a spindle 28. The print head assembly 10 of the processing station faces the support plate 11, which is optionally arranged to attract the web to the support plate by applying a suction force to a contact side of the web W. The web transport assembly further comprises a control unit 100, which is operatively connected to the print head assembly 10, the radiation curing station 30 and to the transport device 20.

As shown in FIG. 2B, a pair of side guards 40A and 40B is positioned on the support platen 11 and connected to the support platen 11 to guide side edges $S_1$, $S_2$ of the web W, respectively. The guards 40A, 40B are arranged at the side edges $S_1$, $S_2$, respectively, of the web W with respect to the transverse direction C perpendicular to the transport path, i.e. perpendicular to the transport direction T.

Each of the guards 40A, 40B may comprise a connecting portion for connecting the guard 40A, 40B to the support platen 11, such as a connecting pin protruding in a direction perpendicular to the plane of the support platen 11 or a screw for fastening the guard 40A, 40B the support platen. Additionally, the support platen may comprise a receiving portion, such as a hole shaped for receiving and retaining a connecting pin or a screw. Alternatively, the receiving portion may comprise a groove shaped for receiving and retaining a connecting portion of the guard while allowing a sliding movement of the guard in a direction parallel to the plane of the support platen 11. Said groove 19, which is shown in FIG. 2B, is directed along the transverse direction C perpendicular to the transport path. In this way, a guard 40A, 40B may be positioned along the groove 19 by a sliding movement to position the respective guard 40A, 40B relative to the transport path of the web W based on a width of the web W across the transport path (i.e. in the transverse direction C). In this way, the guards 40A, 40B are suitably positioned on the support platen 11 to guide the side edges $S_1$, $S_2$ of the web W in the transport direction T along the transport path over the support platen 11.

Figure 4:
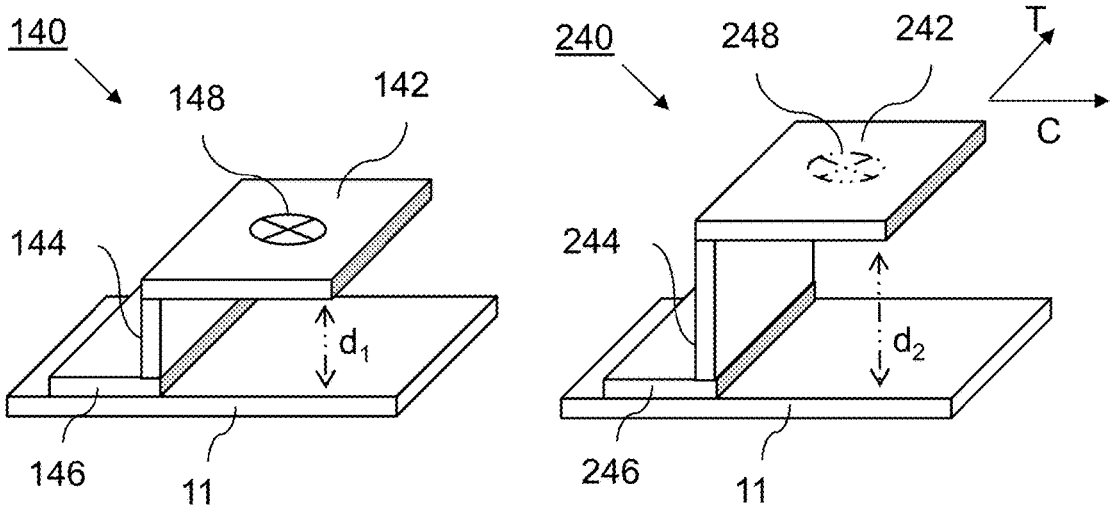
FIG. 4 shows schematically in a perspective view a kit comprising a first guard and a second guard according to the present invention.

Each of the pair of side guards 40A, 40B is selected from a first guard 140 and a second guard 240, which are shown in FIG. 4. FIG. 4 shows a kit comprising the first guard 140 and the second guard 240, respectively, in an assembled state wherein the guard 140, 240 is connected to the support platen 11.

As shown in FIG. 4, each of the first guard 140 and the second guard 240 comprises a guard portion 142, 242, a bridging portion 144, 244 and a contact portion 146, 246. The contact portion is arranged for contacting the support platen 11. The bridging portion 144, 244 is shaped for raising the guard portion away from the support platen 11, when the guard 140, 240 is in the assembled state, and for guiding a side edge of the web $S_1$, $S_2$ along the transport path. The guard portion 142, 242 is arranged facing the support platen 11 and positioned at a predetermined gap $d_1$, $d_2$ from the support platen 11 in the assembled state. Each of the guard portions 142, 242 is arranged for guarding a side edge of the web, i.e. limiting a deformation or protrusion of the side edge of the web away from the support platen 11.

The predetermined gap $d_1$ of the first guard 140 is different from the predetermined gap $d_2$ of the second guard 240. In this example $d_2$ is larger than $d_1$. As a result, the second guard 240 may accommodate a web W, i.e. a side edge of the web W, having a larger thickness than a web, which may be accommodated by the first guard 140.

Furthermore, each guard 140, 240 comprises a marker 148, 248, which provides an identifier for identifying the first guard 140, 240, respectively. As such, the marker 148 of the first guard 140 is different from the marker 248 of the second guard 240. In an example, the marker 148, 248 is a binary code indicating the predetermined gap $d_1$, $d_2$ of the first guard 140 and the second guard 240, respectively.

Optionally each guard 140, 240 may comprise a connecting portion (not shown), such as a connecting pin, for connecting the guard 140, 240 to the support platen 11.

Alternatively, each guard 140, 240 may be temporarily connected to the support platen by means of a tape or by means of a self sticking surface of the contact portion 146, 246.

Additionally, the marker 148, 248 may indicate a size of the guard portion 142, 242 in a plane parallel to the support platen 11, such as a width of the guard portion 142, 242 in a transverse direction C perpendicular to a transport path of the web, and/or may indicate a position of the edges of the guard portion 142, 242 relative to the marker 148, 248.

Figure 5:
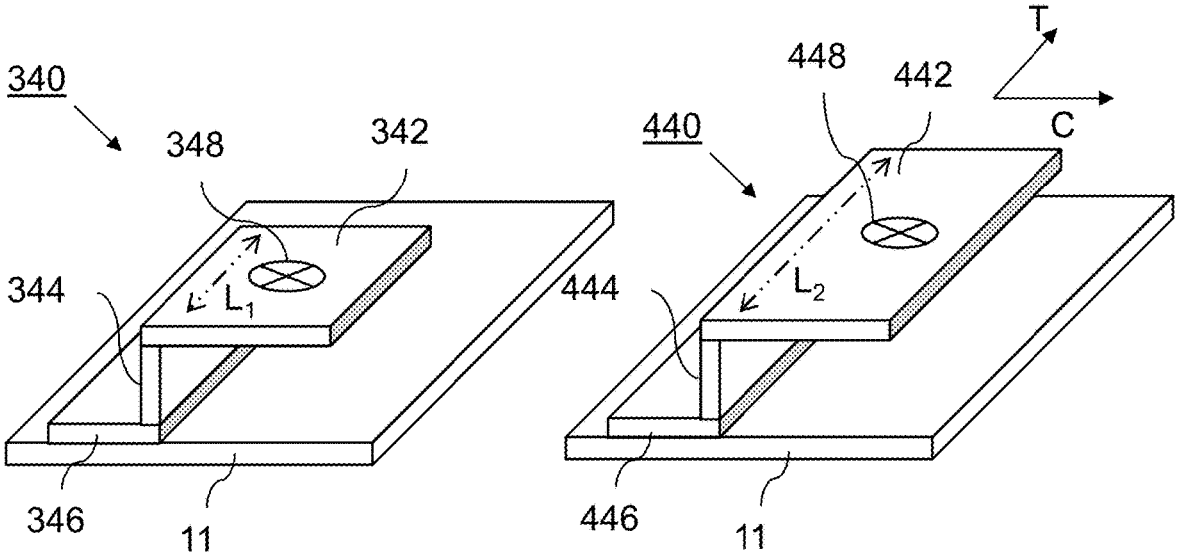
FIG. 5 shows schematically in a perspective view another embodiment of a kit comprising a first guard and a second guard according to the present invention.

In an alternative embodiment of the method for processing a web in the apparatus 80 shown in FIGS. 2A and 2B, each of the pair of side guards 40A, 40B is selected from a first guard 340 and a second guard 440, which are shown in FIG. 5. FIG. 5 shows a kit comprising the first guard 340 and the second guard 440, respectively, in an assembled state wherein the guard 340, 440 is connected to the support platen 11.

The first guard 340 and the second guard 440 have the same elements as the first guard 140 and the second guard 440 shown in FIG. 4. In particular, each guard 340, 440 comprises a guard portion 342, 442, which is arranged facing the support platen 11, a bridging portion 344, 444 and a contact portion 346, 446.

Each of the guard portions 142, 242 is arranged for guarding a side edge of the web, i.e. limiting a deformation or protrusion of the side edge of the web away from the support platen 11, along a guarding length $L_1$ and $L_2$, respectively, in the transport direction T. The guarding length $L_1$ of the first guard 340 is different from the guarding length $L_2$ of the second guard 440. In this example $L_2$ is larger than $L_1$. As a result, the second guard 440 may guide a web W, i.e. a side edge of the web W, over a larger distance along the transport path of the web, i.e. in the transport direction T.

Furthermore, each guard 340, 440 comprises a marker 348, 448, which provides an identifier for identifying the first guard 340, 440, respectively. As such, the marker 348 of the first guard 340 is different from the marker 448 of the second guard 440. In an example, the marker 348, 448 is a binary code indicating the guarding length $L_1$, $L_2$ of the first guard 340 and the second guard 440, respectively.

The control unit 100 of the apparatus 80, shown in FIG. 2A-2B, may adjust a processing parameter, such as a processing area 110, of the processing station 10 based on detection of the marker 148, 248, 348, 448, respectively and knowledge of the position of the guarding portion 142, 242, 348, 448 relative to the support platen 11. In an example, the processing station 10 comprises a detector arranged for detecting a marker 148, 248, 348, 448 of the guard 40A, 40B positioned and connected to the support platen 11. The detector may be mounted on a carriage of the printing station 10, such as the carriage 13 shown in FIG. 1B. The detector is operatively connected to the control unit 100 to provide a detection signal to the control unit 100 indicating the detected marker 148, 248, 348, 448 of the guard 40A, 40B.

The control unit 100 is configured for identifying the guard 40A, 40B, i.e. determining which of the first guard 140, 340 and the second guard 240, 440 is connected to the support platen 11. The control unit 100 is connected to a database comprising a list of markers, each being related to a specific guard 140, 240, 340, 440, the database including shape attributes of the specific guard 140, 240, 340, 440, such as predetermined gap $d_1$, $d_2$ and/or size of the guard portion 142, 242, 342, 442, such as guarding length $L_1$, $L_2$.

Additionally, the control unit 100 may be configured to check an orientation of the connected guard 40A, 40B relative to the support platen 11 based on the detected marker 148, 248, 348, 448. In an example, the control unit 100 may check, how the guard portion 142, 242 of each of the left guard 40A and the right guard 40B, relative to the transport direction, is arranged relative to the contact portion 146, 246 to correctly guide the respective side edge $S_1$, $S_2$ of the web W along the transport path.

Figure 3:
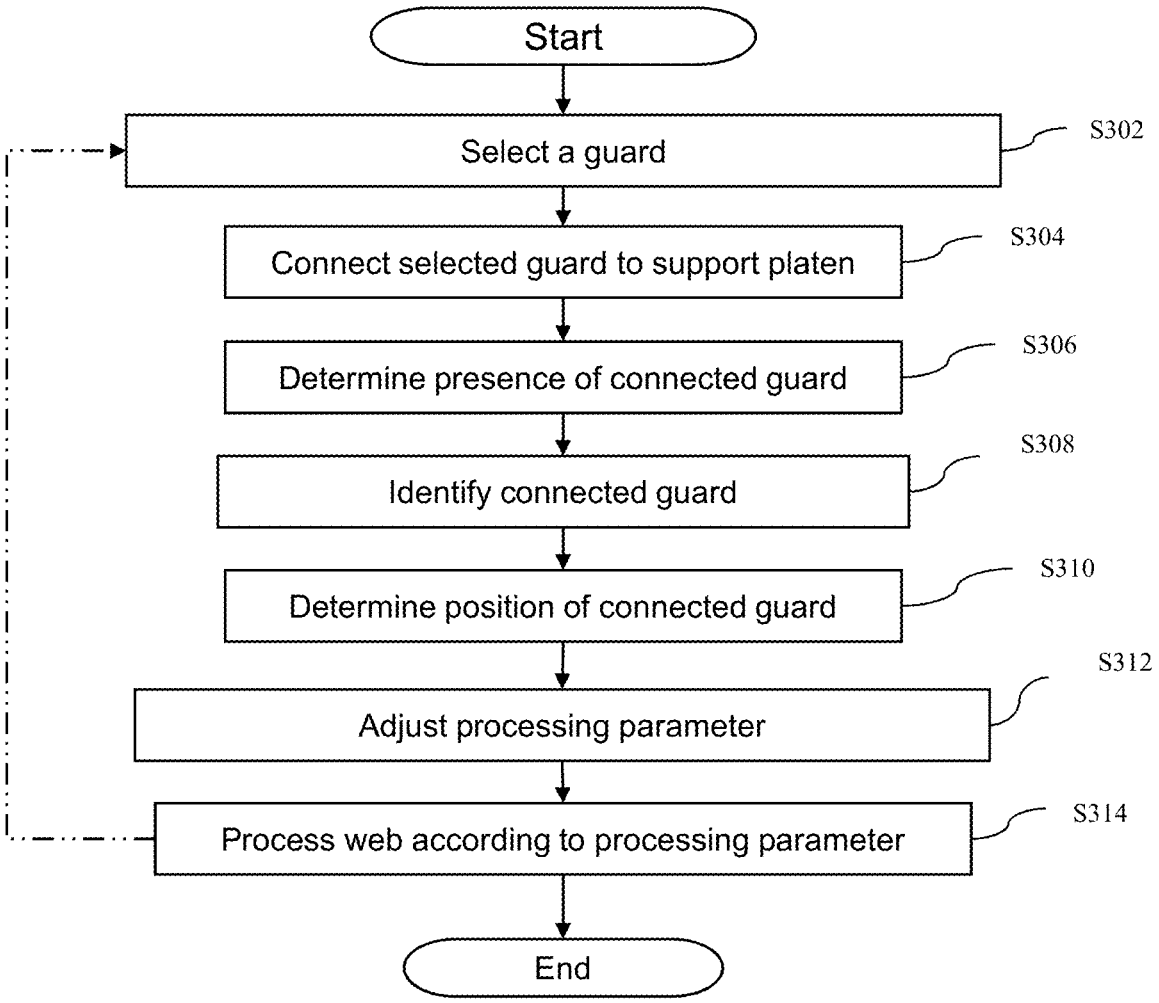
FIG. 3 shows in a flow diagram an embodiment of a method for processing a web in an apparatus according to the present invention.

FIG. 3 shows in a flow diagram an embodiment of a method for processing a web in an apparatus 80 according to the present invention.

In a first step S302, a guard is selected from a first guard 140 and a second guard 240 by an operator of the apparatus 80 based on a web W to be processed by the apparatus. In particular, the operator selects the guard based on a thickness of the web and based on a predetermined distance $d_1$, $d_2$ of the first guard 140 and the second guard 240, respectively. In a particular example, the operator selects the same type of guard for both side edges $S_1$, $S_2$ of the web, as the thickness of the web is substantially independent of the specific edge of the web W.

In a next step S304, the operator connects the selected guard (140 or 240) to the support platen 11 at a desired position relative to the transverse direction c to guide a respective edge $S_1$, $S_2$ of the web W. The guard 140, 240 may be connected to the support platen 11 by using a connecting portion of the guard 140, 240. Alternatively, the guard 140, 240 may be connected to the support platen 11 by applying tape to the contacting portion 146, 246 of the first guard 140 or the second guard 240, respectively.

In a next step S306, a presence of the connected guard at the support platen 11 is determined by the apparatus 80. In an example, the apparatus comprises a cover arranged for providing an entry for the operator to the support platen 11, when arranged in an opening state. The control unit 100 is operatively connected to the cover to determine the opening state and/or closing state of the cover. In case the cover is moved in the opening state by the operator, the control unit 100 assumes that a guard is to be connected to the support platen 11. The control unit 100 may move the processing station 10 away from the support platen 11, e.g. in a plane parallel to the support platen, to support access of the operator to the support platen 11. Furthermore, the control unit 100 may raise the processing station 10 to a predetermined safe distance above the support platen 11, i.e. in a direction perpendicular to the plane of the support platen 11, to avoid any damage occurring to the processing station 10 during any further movements of the processing station over the support platen 11.

In another example, the presence of the connected guard 40A, 40B may be communicated to the control unit 100 of the apparatus 80 by an operator input, such as by using an input device of the apparatus.

In a next step S308, the connected guard 40A, 40B is identified. The identification of the connected guard may be carried out by using a detector mounted on a carriage of the printing station 10, such as the carriage 13 shown in FIG. 1B. The detector is operatively connected to the control unit 100 to provide a detection signal to the control unit 100 indicating a detected marker 148, 248 of the guard 140, 240.

In an alternative example of the step, the operator may identify the connected guard 40A, 40B, e.g. as the guard is also selected by the operator. The operator may provide an operator input to the control unit 100 of the apparatus to communicate the identity of the connected guard 40A, 40B.

In a next step S310, the position of the connected guard 40A, 40B is determined. The position of the guard 40A, 40B on the support platen 11 may be determined by the detector for detecting the guard 40A, 40B. In example, the detector detects the detected marker 148, 248 of the guard 140, 240 and provides a detection signal to the control unit 100 based on the detected marker 148, 248. The control unit 100 determines the position of the connected guard 40A, 40B based on the position of the detected marker 148, 248. Optionally, the control unit 100 may determine a position of the guard portion 142, 242 relative to the support platen 11 based on the detected marker 148, 248 and further based on a known distance between the marker 148, 248 and side edges of the guard portion 142, 242. In this way, the control unit 100 exactly knows the position of the guard portion relative to the support platen, both in a direction of the plane of the support platen 11 and in a height direction perpendicular to the plane of the support platen 11.

In a next step S312, the control unit 100 adjusts a processing parameter of the processing station 10. In a first example, a gap between the processing station and the support platen, which is maintained during processing of the web, is adjusted based on a predetermined distance d1, d2 of the selected guard 140, 240. In this way, based on the knowledge of the shape of the selected guard 140, 240, a collision of the processing station 10, such as a moveable print station, to the connected guard 40A, 40B is avoided while optimizing a processing distance between the processing station 10 and the web W.

In a second example, the print area 110 relative to the support platen 11 to be processed by the printing station 10 is adjusted based on the determined presence of the connected guard. In this way, it may be avoided that the guard is polluted by an ink to form an image, which ink is printed by the print station 10 onto the web W in the print area 110. In case the ink is a radiation curable ink, such ink may provide a safety risk, when the ink pollutes the connected guard and is not cured by a radiation source 30, which is arranged away from the support platen 11 facing the print station 10, such as downstream from the print station 10 in a transport direction T of the web W.

In a next step S314, the web W is processed according to the adjusted processing parameter, as adjusted in step S312. In this way, an optimised processing of the web w is obtained.

After processing the web W, the method can be reiterated by an operator by starting again from step S302 and performing the steps S302-314, wherein another guard is selected from a first guard 140, 340 and a second guard 240, 440, shown in FIGS. 4 and 5, based on another web to be processed by the apparatus 80.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An apparatus comprising:

a processing station for processing a web;

a transport device for transporting the web through a transport path along the processing station;

a support platen facing the processing station for supporting the web, when being processed by the processing station;

a first guard for guarding a side edge of a web, the first guard being connectable to the support platen for guiding the web along the transport path, when the web is processed by the processing station;

a detector for detecting the first guard when connected to the support platen; and a control unit configured for controlling the processing station to process the web, wherein the control unit is configured to identify the guard based on a detection signal provided by the detector to the control unit, wherein the control unit is further configured to control movement of the processing station based on the detection and identification of the first guard by the detector, to prevent contact between the processing station and the first guard connected to the support platen.

2. The apparatus according to claim 1, wherein the apparatus further comprises a moveable carriage for moving the processing station with respect to the support platen, wherein the detector and the processing station are mounted on the carriage.

3. The apparatus according to claim 1, wherein the first guard further comprises:

a connection base connectable to the support platen;

a restrictor plate for restricting deformation of the web in a direction away from the support platen; and a spacer connecting the connection base to the restrictor plate, the spacer being configured for positioning the restrictor plate at a predefined distance from the support platen when the connection base is connected to the support platen.

4. The apparatus according to claim 1, wherein the control unit is configured for determining the position of the connected guard with respect to the support platen.

5. The apparatus according to claim 1, wherein the processing station is arranged having a gap with respect to the support platen during processing of the web and wherein control unit is configured for adjusting a gap based on an identity of the identified guard.

6. The apparatus according to claim 1, wherein the control unit comprises a memory storing an identity table, wherein the control unit is arranged for selecting a guard from the identity table based on the detection signal.

7. The apparatus according to claim 1, wherein the first guard comprises an identifier attribute for identifying the guard.

8. The apparatus according to claim 7, wherein the identifier attribute comprises a marker on the first guard.

9. The apparatus according to claim 8, wherein the marker comprises identity information readable by the detector.

10. The apparatus according to claim 9, wherein the identifier attribute comprises a color of the first guard.

11. A method of controlling the processing station in the apparatus according to claim 1, the method comprising the steps of:

sensing, with the detector, the first guard for guarding the side edge of the web when connected to the support platen of the apparatus;

identifying the first guard from data generated by the detector;

controlling the movement of the processing station to avoid contact with the identified first guard.

12. The method according to claim 11, further comprising:

determining a height parameter of the identified first guard; and adjusting a gap between the processing station and the support platen based on the height parameter.

13. The method according to claim 11, further comprising:

determining a position of the identified first guard; and controlling a translational movement of the processing station over the support platen, such that the processing stations avoids the determined position.

14. The apparatus according to claim 1, wherein the control unit is further configured to control movement of the processing station in a scanning direction based on the detection and identification of the first guard by the detector, to prevent contact between the processing station and the first guard connected to the support platen.

* * * * *